US005478019A

United States Patent [19]

Morikawa et al.

[11] Patent Number: 5,478,019

[45] Date of Patent: Dec. 26, 1995

[54] UNIVERSAL BREAKER

[75] Inventors: Sumio Morikawa, Sakai; Nobuyuki Zakohji, Toyonaka, both of Japan

[73] Assignee: Ohyodo Diesel Co., Ltd., Osaka, Japan

[21] Appl. No.: 171,745

[22] Filed: Dec. 22, 1993

[30] Foreign Application Priority Data

Jun. 16, 1993 [JP] Japan ..... 5-144449

[51] Int. Cl.[6] ..... B02C 1/08

[52] U.S. Cl. ..... 241/101.73; 241/266

[58] Field of Search ..... 241/101.7, 266, 241/264; 414/729, 734; 901/39

[56] References Cited

U.S. PATENT DOCUMENTS

| | | | |
|---|---|---|---|
| 4,196,862 | 4/1980 | Tagawa | 241/101.7 X |
| 4,201,348 | 5/1980 | Bigbee et al. | 241/101.7 |
| 4,512,524 | 4/1985 | Shigemizu | 241/101.7 |
| 4,890,798 | 1/1990 | Tagawa et al. | 241/101.7 X |
| 4,934,616 | 6/1990 | Zepf | 241/101.7 X |
| 4,951,886 | 8/1990 | Berto | 241/101.7 |
| 4,955,961 | 9/1990 | Tagawa | 241/101.7 X |
| 4,961,543 | 10/1990 | Sakato et al. | 241/101.7 X |
| 5,183,216 | 2/1993 | Wack | 241/101.7 |
| 5,187,868 | 2/1993 | Hall | 241/101.7 X |

FOREIGN PATENT DOCUMENTS

| | | |
|---|---|---|
| 8904094 U | 6/1990 | Germany . |
| 2232470 | 9/1990 | Japan . |
| 2146918A | 5/1985 | United Kingdom . |
| WO86/03701 | 7/1986 | WIPO . |

*Primary Examiner*—Timothy V. Eley
*Attorney, Agent, or Firm*—Nikaido, Marmelstein, Murray & Oram

[57] ABSTRACT

A universal breaking machine is provided which comprising a pair of movable arms pivotably connected to a support frame for open-close movement, and a hydraulic cylinder for causing the open-close movement of the pair of movable arms. The pair of movable arms are adapted to secure detachably, at the opposite, forward end surfaces thereof, a set of or a pair of tool rests for long cutter having a long cutter thereon, tool rests for short cutter having, at the rearward end thereof, a short cutter of a length smaller than that of the long cutter, and having a crusher at the forward end thereof, or smashing blocks having a plurality of large protrusions. A secondary breaking attachment having a plurality of small protrusions thereon may be removably attached, as desired, to the opposite, forward-most surfaces of the pair of movable arms. In a preferred embodiment, a first ring is removably attached to a pivot portion of the pair of movable arms, at which the movable arms are attached to the support frame, on the surface opposite to the surface on which the cutter is to be attached. A second ring, confronting the first ring, is also removably attached to the support frame.

6 Claims, 3 Drawing Sheets

UNIVERSAL BREAKER

FIELD OF THE INVENTION

This invention relates to a universal breaking machine adapted to be attached to a drive arm of a working machine, such as a power shovel, at the forward end thereof for breaking or deconstructing buildings or the like of a reinforced concrete construction.

BACKGROUND OF THE INVENTION

In order to de-constructing constructions, such as buildings or bridges made of reinforced concrete, it is common to use a breaking machine or breaker which is adapted to be attached to a forward end of a drive arm of a working machine, such as power shovel. One example of such breaking machines is known, as disclosed In Japanese Patent Public Disclosure No. 02(1990)-232470, which comprises a pair of movable arms pivotably attached, at the intermediate portions thereof, to a support frame, and a hydraulic cylinder connected to the rearward end of each of the pair of movable arms. When the hydraulic cylinder Is actuated to be extended or retracted, the pair of movable arms are rotated to be closed or opened so as to clamp at the forward ends thereof a concrete material therebetween.

It is noted that various operations, such as crushing of concrete material, secondary crushing of such concrete material, and shearing of steel bars or steel frames, are involved In deconstruction work for construction, such as buildings of reinforced concrete, or bridges. It should be noted, however, that such various operations could not be performed by a single breaking machine of prior art as mentioned above. Thus, it is necessary, according to prior art, to provide a plurality of shearing machines or breaking machines suitable for individual operations, such as shearing of steel bars or steel frame, crushing of concrete material, or secondary crushing of such concrete material, so that a particular breaking machine or crushing machine may be selectively attached to the tip of a drive arm of a working machine, depending upon particular operation. In this regard, it should be noted that replacement of such breaking machine or crushing machine is time-consuming, and thus, efficient and quick de-construction work cannot be expected.

It is also noted that play or backlash may be created between the pair of movable arms after prolonged use thereof, so that steel bars or steel frames cannot be sheared accurately. Such play is caused from abrasion or wear of the slide surface of the movable arms, opposite to the surface on which the cutter is attached, and the surface of tile support frame in slidable engagement of the slide surface of the movable arms, due to a force component, generated upon shearing of steel bars or steel frames, in the direction perpendicular to the direction in which the movable arms are opened and closed, the force component tending to separate the pair of movable arms from one another. In such case, it is necessary for the movable arms to be repaired or replaced with new ones so as to facilitate secure shearing of steel bars or steel frames. This is disadvantageous in view of economy.

SUMMARY OF THE INVENTION

In view of the above problems experienced in prior art, it is a main object of the invention to provide a universal breaking machine which permits a single working machine to perform operations including shearing of steel frames and steel bars, crushing of concrete bodies and secondary crushing of such crushed concrete bodies.

In order to achieve the above object the invention provides a universal breaking machine which comprises a pair of movable arms pivotably connected to a support frame for open-close movement, and a hydraulic cylinder for causing the open-close movement of the pair of movable arms wherein the pair of movable arms are adapted to secure detachably, at the opposite, forward end surfaces thereof, a set of or a pair of tool rests for a long cutter having a long cutter thereon, tool rests for a short cutter having, at the rearward end thereof, a short cutter of a length smaller than that of the long cutter, and having a crusher at the forward end thereof, or smashing blocks having a plurality of large protrusions, and wherein a secondary breaking attachment having a plurality of small protrusions thereon may be removably attached, as desired, to the opposite, forward-most surfaces of the pair of movable arms.

According to one preferred embodiment of the invention, a first ring is removably attached to a pivot portion of the pair of movable arms, at which the movable arms are attached to the support frame, on the surface opposite to the surface on which the cutter is to be attached, and a second ring, confronting to the first ring, is removably attached to the support frame.

In accordance with the invention, it is possible to shear steel bars when tool rests for long cutter are attached to the pair of movable arms at the forward, opposite ends thereof. When tool rests for short cutter are mounted on the movable arms, it is possible to crush concrete material and to shear steel bars contained in such concrete material. Furthermore, and when smashing blocks, together with secondary crushing attachments, are mounted on the movable arms at the forward, opposite surfaces and forward-most, opposite end surfaces thereof, respectively, it is possible to perform secondary crushing of concrete material.

When play or backlash Is created between the pair of movable arms after prolonged use thereof, whereby steel bars or steel frames cannot be sheared accurately (such play is caused from abrasion or wear of the slide surface of the movable arms, opposite to the surface on which the cutter is attached, and the surface of the support frame in slidable engagement of the slide surface of the movable arms, due to a force component, generated upon shearing of steel bars or steel frames, in the direction perpendicular to the direction In which the movable arms are opened and closed, the force component tending to separate the pair of movable arms from one another), It Is possible to eliminate such play between the movable arms by replacing the rings mounted on the movable arms and support arms, respectively, with new ones.

DETAILED DESCRIPTION OF THE PREFERRED EMBODIMENTS

The invention will be explained below with reference to several embodiments shown in FIGS. 1 to 5.

Figure 1:
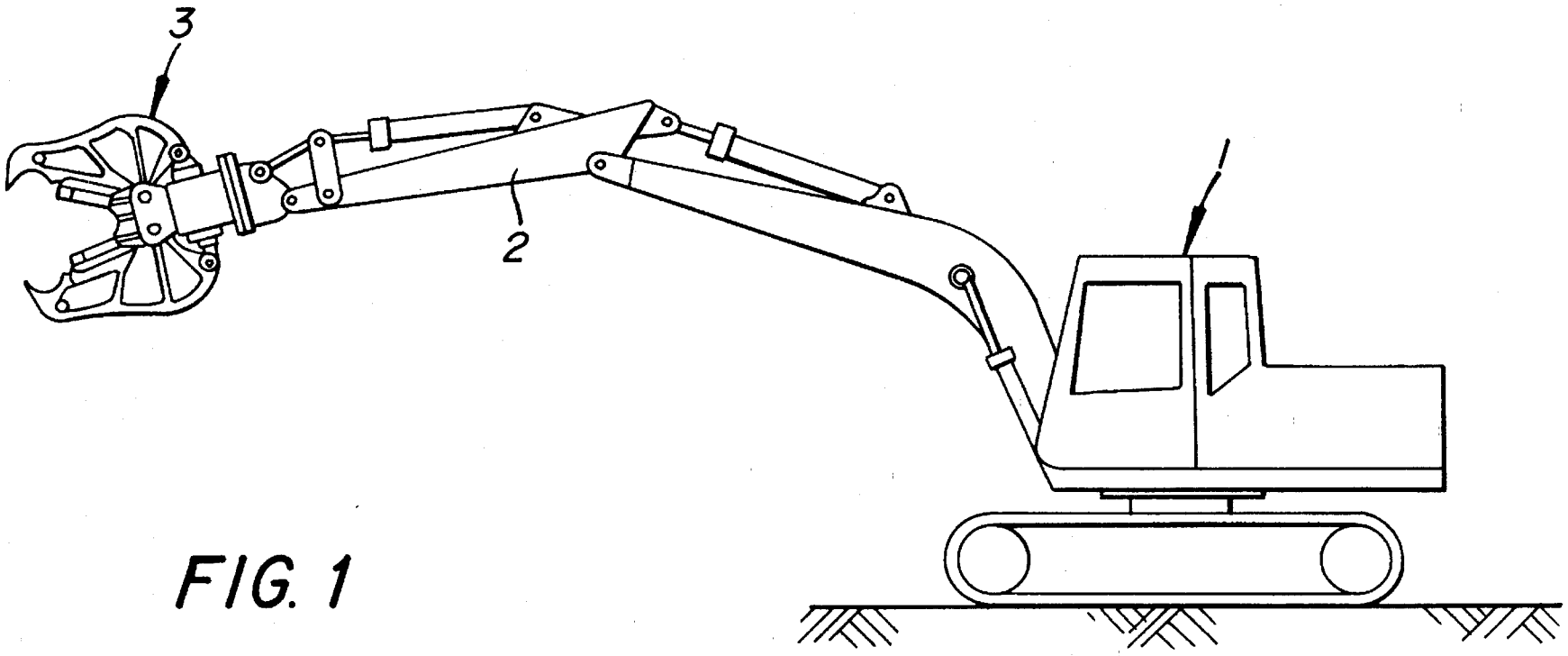
FIG. 1 is a side elevational view of a working machine provided with a universal breaker according to the invention.

FIG. 1 illustrates a working machine 1, such as a power shovel, having a drive arm 2. The drive arm 2 is mounted, at the forward end thereof, with a universal breaker 3 according to the invention. The universal breaker 3 includes, as shown in FIG. 2, a pair of movable arms 5, 5 attached to a support frame 4 for open-close movement, and a hydraulic cylinder 6 for pivoting the pair of movable arms 5,5 to be opened and closed.

Figure 3:
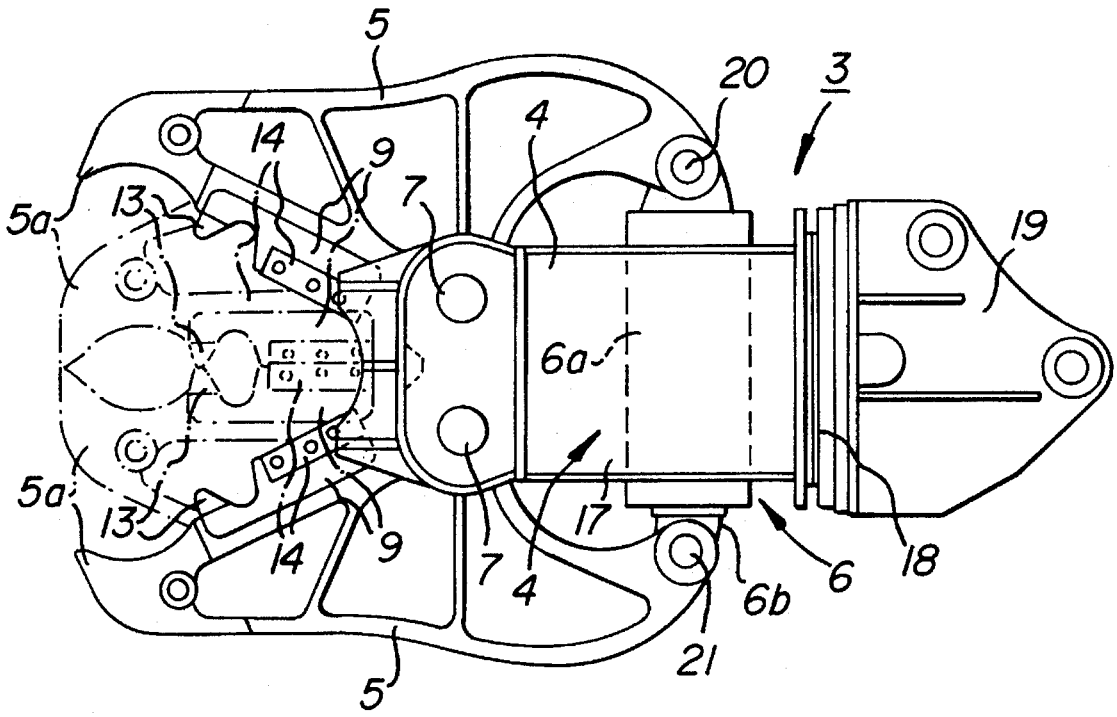
FIG. 3 is a side elevational view of the universal breaker according to the invention mounted with a tool rest for a short cutter.
Figure 4:
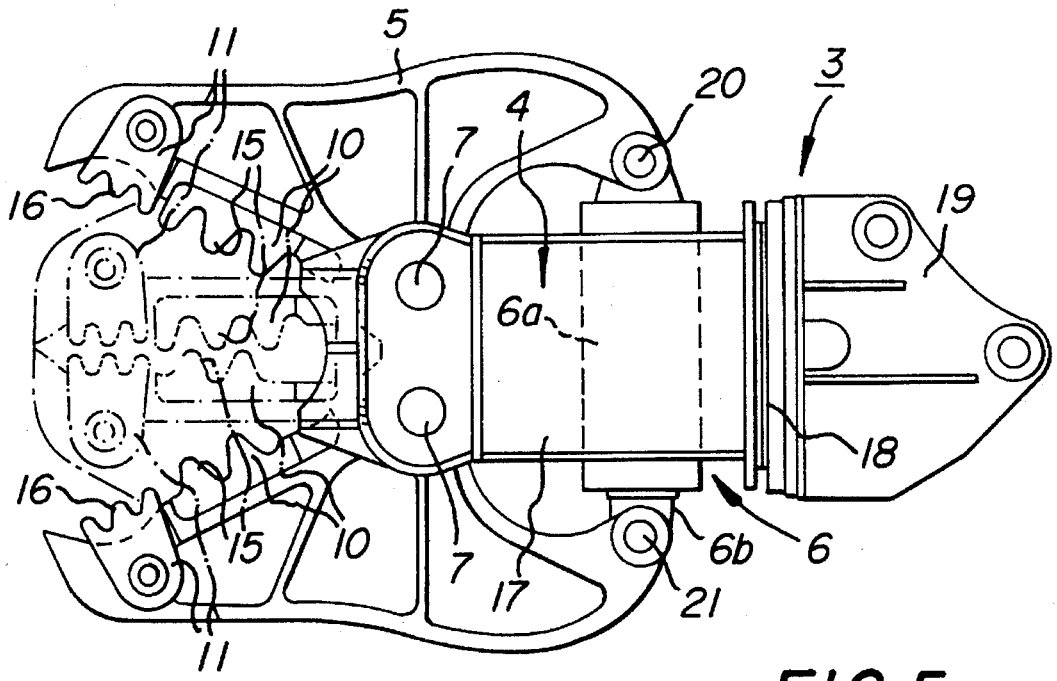
FIG. 4 is a side elevational view of the universal breaker according to the invention mounted with a smashing block.
Figure 5:
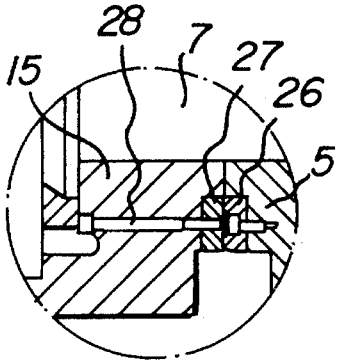
FIGS. 5, 5A are enlarged sectional view, showing a support portion for a pair of movable arms.
Figure 5A:
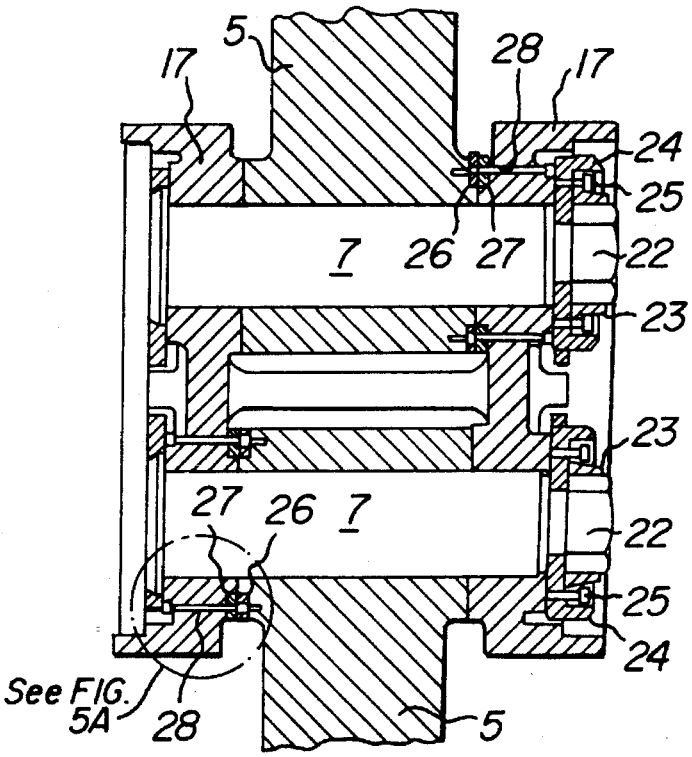

The pair of movable arms 5, 5 are pivotably connected to the support frame 4 in a symmetrical manner by means of separate support shafts 7, 7, respectively. As shown in FIGS. 2 to 4, tool rests for a long cutter 8, 8, tool rests for a short cutter 9, 9, or smashing blocks 10, 10 can be removably attached to opposite surfaces of the forward ends of the pair of movable arms 5, 5. As shown In FIG. 4, secondary braking attachments 11,11 are removably attached to opposite surfaces of the tip ends of the movable arms.

Figure 2:
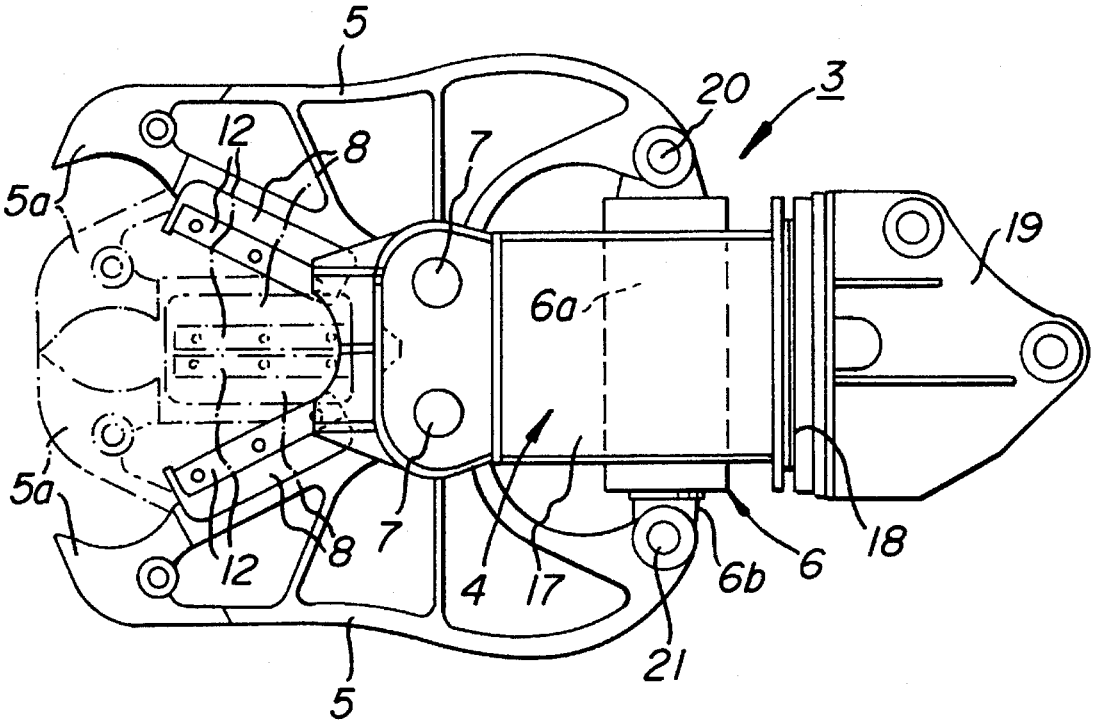
FIG. 2 is a side elevational view of the universal breaker according to the invention mounted with a tool rest for a long cutter.

The tool rest for long cutter 8 is mounted with a long cutter 12 which extends along substantially the entire length of the tool rest, as shown in FIG. 2. The long cutter 12 is capable of shearing steel frames, such as an H beam.

The tool rest for short cutter 9 includes, at its forward side, a crusher 13 being integral therewith, and, at its rearward side, a short cutter 14 attached thereto. The crusher is capable of breaking or crushing a concrete construction, while the short cutter 14 is capable of shearing reinforcing bars. Thus, the tool rest for short cutter 9 may be used to crush a concrete construction and to shear reinforcing bars contained in a concrete construction. In this connection, it is noted that, since the short cutter 14 is disposed at the rearward side and the crusher 13 is disposed at the forward side, it is possible to crush or break a concrete construction by means of the forward portion of the tool rest having a relatively large opening, and to securely shear reinforcing bars by means of the rearward portion of the tool rest.

The smashing block 10 includes a plurality of large protrusions 15 arranged along substantially the entire length of the smashing block, as shown In FIG. 4. The large protrusions 15 are capable of performing secondary crushing or breaking of a concrete construction. That is, the smashing block 10 is used to further crush concrete blocks into pieces for facilitating handling thereof, the concrete blocks resulting from crushing or breaking of a concrete construction by means of the forward end 5*a* of the movable arm 5 or the crusher 13 of the tool rest for the short cutter.

The secondary breaking attachment 11 includes a plurality of small protrusions 16, as shown in FIG. 4. The small protrusions 16 are capable of crushing a concrete block into pieces. Thus, the secondary breaking attachment 11 is used, together with the smashing block 10, so as to further crush concrete blocks into pieces for facilitating handling thereof, the concrete blocks resulting from crushing or breaking of a concrete construction by means of the forward end 5*a* of the movable arm 5 or the crusher 13 of the tool rest for short cutter 9.

The support frame 4 includes a pair of bifurcated support arms 17, 17 formed integral therewith and extending from the rearward portion to the forward portion of the support frame 4. The pair of movable arms 5, 5 are pivotably connected between the support arms 17, 17 by means of the respective support shaft 7, 7 so that the movable arms 5, 5 can be opened and closed. A mounting bracket 19 is pivotably attached to the support frame 4 at the rearward end thereof by means of a rotary bearing 18. The mounting bracket 19 is connected swingably to the forward end of the drive arm 2 of the working machine 1 through a pin. The support frame 4 is connected to a rotating mechanism (not shown) so as to be rotated through 360 degrees relative to the mounting bracket 19.

A hydraulic cylinder 6 is disposed between the support arms 17, 17 of the support frame 4. A cylinder body 6*a* is pivotably connected to one of the movable arms 5, at the rearward end thereof, through a pin 20. A forward end of a piston rod 6*b* extending from the cylinder body 6*a* is pivotably connected to the other of the movable arms 5, at the rearward end thereof, through a pin 21. When the piston rod 6*b* is extended from the cylinder body 6*a*, the pair of the movable arms 5, 5 are pivoted about the support shafts 7, 7, respectively, to be closed. When the piston rod 6*b* is retracted into the cylinder body 6*a*, the pair of movable arms 5, 5 are pivoted about the support shafts 7, 7, respectively to be opened.

The support shafts 7, 7 are supported between the support arms 17, 17 of the support frame 4 in parallel relationship with each other, and tightened by nuts 22, 22, respectively. The nuts 22, 22 are secured by detents 23, 23, respectively, so as not to be loosened upon actuation of the movable arms 5, 5. The detent 23 is attached to a bolt 25 by means of a retainer 24. The retainer 24 is prevented against rotation by means of the support arm 17.

An arm-side ring 26 is attached, through a key (not shown), to a slide surface, opposite to the blade when installed, of the intermediate portion, i.e., the support portion carried by the support shaft 7, of each of the pair of movable arms 5, 5. Frame-side ring 27, 27, opposite to the corresponding arm-side rings 26, 26, are removably attached to the respective support arms 17, 17 of the support frame 4. Each frame-side ring 27 is mounted on the support arm 17 by means of a bolt 28 extending through the support arm 17. It is noted that, upon installation of the rings, the bolts 28 are manipulated outwardly of the support arms 17 go as to be tightened.

One exemplary operation of the universal breaking machine 3 according to the invention, as constructed above, will be explained below.

When hydraulic fluid is supplied to the hydraulic cylinder 6 for extension or retraction movement thereof, the pair of movable arms 5, 5 are rotated about the respective support shaft 7, 7 so as to be closed or opened. When the tool rests for long cutter 8 are installed on the pair of movable arms 5, 5 in the opposed, forward surfaces thereof, as shown in FIG. 2, it is possible to shear or cut steel frames. When, as shown in FIG. 3, the tool rest for short cutter 9 having, at the forward end thereof, the crusher 13 being integral therewith, is installed on the movable arms, it is possible to crush concrete material by means of the crusher 13, and to shear or cut steel frames contained in such concrete material. Furthermore, and when the smashing block 10, together with the secondary breaking attachment 11 at the forward-most end of the movable arm, is installed as shown in FIG. 4, it is possible to break concrete material into smaller pieces. Thus, operation including shearing of steel bars or steel frames, crushing of concrete material, and secondary breaking of concrete material, as required upon deconstruction of building or bridges of reinforced concrete construction, may be performed by a single working machine.

When the arm-side rings 26,26 attached to the pair of movable arms 5, 5 at the side surface thereof, opposite to the side surface on which the cutter is mounted, and the frame-side rings 27, 27 attached to the support arms 17, 17 of the support frame 4 in opposite relationship with the arm-side rings wear out, due to a force component, caused upon shearing of steel bars or steel frames, acting in the direction perpendicular to the open-close direction of the pair of movable arms 5, 5, and tending to separate the movable arms from one another, it is possible to obviate such play between the movable arms by simply replacing the rings 26, 26, and rings 27, 27 with new ones so as to facilitate secure cutting or shearing of steel bars or steel frames. This is advantageous in view of economy over the prior art in which the pair of movable arms per se, when worn out, should be repaired or replaced with new ones.

In the above embodiment, the pair of movable arms 5, 5 are actuated by means of a single hydraulic cylinder. It is noted, however, that the pair of movable arms 5, 5 may be separately actuated by their respective hydraulic cylinders.

In accordance with the invention, various operations, including shearing of steel bars or steel frames, crushing of concrete material, and secondary crushing of such concrete material, may be performed by means of a single breaking machine. Accordingly, the breaking machine of the invention permits efficient and quick de-construction work for constructions, such as buildings or bridges of reinforced concrete construction. The breaking machine of the invention may be usefully applied to various fields.

We claim:

1. A universal breaking machine comprising:

a support frame;

a pair of movable pivot arms pivotably connected to said support frame for open and close movement, wherein each of said movable pivot arms has a forward cutting end surface and a pivot portion;

a hydraulic cylinder capable of causing the open and close movement of said pair of movable pivot arms operationally attached to said pair of movable pivot arms;

a tool rest for long cutters detachably secured to each of said forward end surfaces of said movable pivot arms, each tool rest defining a longitudinal direction; and a long cutter attached to each of said tool rests for long cutters, each said long cutter extending in a respective said longitudinal direction.

2. A universal breaking machine as claimed in claim 1, further comprising:

a first ring removably attached to each of said pivot portions of said movable pivot arms on a surface opposite to a surface on which said cutter is attached to said movable pivot arms; and a second ring removably attached to said support frame.

3. A universal breaking machine comprising:

a support frame;

a pair of movable pivot arms pivotably connected to said support frame for open and close movement, wherein each of said movable pivot arms has a forward end surface and a pivot portion;

a hydraulic cylinder capable of causing the open and close movement of said pair of movable pivot arms operationally attached to said pair of movable pivot arms;

a tool rest for short cutters detachably secured to each of said forward end surfaces of said movable pivot arms, wherein each of said tool rests for short cutters has a rearward and a forward side;

a short cutter attached to the rearward side of each of said tool rest for short cutter; and a crusher attached to the forward side of each of said tool rests for short cutters.

4. A universal breaking machine as claimed in claim 3, further comprising:

a first ring removably attached to each of said pivot portions of said movable pivot arms on a surface opposite to a surface on which said cutter is attached to said movable pivot arms; and a second ring removably attached to said support frame.

5. A universal breaking machine comprising:

a support frame;

a pair of movable pivot arms pivotably connected to said support frame for open and close movement, wherein each of said movable pivot arms has a forward end surface, a tip end and a pivot portion;

a hydraulic cylinder capable of causing the open and close movement of said pair of movable pivot arms operationally attached to said pair of movable pivot arms;

a smashing block having a plurality of large protrusions detachably secured to each of said forward ends of said movable pivot arms; and a secondary breaking attachment detachable secured to each of said tip ends of said movable pivot arms.

6. A universal breaking machine as claimed in claim 5, further comprising:

a first ring removable attached to each of said pivot portions of said movable pivot arms on a surface opposite to a surface on which said cutter is attached to said movable pivot arms; and a second ring removably attached to said support frame.

* * * * *